United States Patent [19]

Orford et al.

[11] 4,101,453

[45] Jul. 18, 1978

[54] SINTERED COMPOSITION

[75] Inventors: Raymond Leslie Orford, Solihull; Dexter William Smith, Hall Green, both of England

[73] Assignee: Lucas Industries Limited, Birmingham, England

[21] Appl. No.: 777,535

[22] Filed: Mar. 14, 1977

[30] Foreign Application Priority Data

Mar. 20, 1976 [GB] United Kingdom ..... 11317/76
Aug. 18, 1976 [GB] United Kingdom ..... 34373/76

[51] Int. Cl.[2] ..... H01B 1/02; H01B 1/04

[52] U.S. Cl. ..... 252/503; 252/504; 264/104; 310/252; 310/253

[58] Field of Search ..... 252/503, 504; 310/253, 310/252; 264/104

[56] References Cited

U.S. PATENT DOCUMENTS

| | | | |
|---|---|---|---|
| 1,040,315 | 10/1912 | Hardman | 252/504 |
| 2,783,405 | 2/1957 | Atkins et al. | 252/503 X |
| 2,989,490 | 6/1961 | Ramadanoff | 252/503 |
| 3,601,645 | 8/1971 | Whiteheart | 310/249 |

OTHER PUBLICATIONS

Introduction to Powder Metallurgy, American Powder Metallurgy Institute, N.Y., 1969, pp. 145–147.

*Primary Examiner*—Benjamin R. Padgett

[57] ABSTRACT

A sintered composition used as a brush for a dynamo electric machine contains copper, carbon and silicon carbide.

10 Claims, No Drawings

SINTERED COMPOSITION

This invention relates to a sintered composition and more particularly to such a composition when employed in a brush for a dynamo electric machine.

A brush for a dynamo electric machine, according to the invention, includes a sintered composition containing copper, carbon and silicon carbide.

Preferably, the sintered composition has substantially the following composition by weight:

| | |
|---|---|
| Carbon | 1 - 8% |
| Silicon Carbide | 0.85 - 5.1% |
| Tin | 0 - 4% |
| Lead | 7.5 - 15.3%, |
| Copper | and remainder |

More preferably, the sintered composition consists of 4% by weight carbon, 1.7% by weight silicon carbide, 2.55% by weight tin and 12.75% by weight lead, the remainder being copper.

The invention further resides in a method of producing a brush for a dynamo electric machine, comprising the step of sintering a powder mixture containing copper, carbon and silicon carbide.

Preferably, the silicon carbide powder in said mixture has a mean particle size between 9 and 18 microns, more preferably has a mean particle size of 12–18 microns, and most preferably a mean particle size of 13 microns.

Preferably, the copper powder in said mixture has a mean particle size of less than 106 microns and more preferably has a mean particle size of 53 microns.

Preferably, the electrical lead for the brush is metallurgically bonded thereto during sintering of said mixture.

In a first example of the invention, a brush for a dynamo electric machine was produced from a powder mixture having the following composition by weight:

| | |
|---|---|
| Copper | 79%, |
| Lead | 12.75%, |
| Tin | 2.55%, |
| Graphite | 4.0%, and |
| Silicon Carbide | 1.7%. |

The mixture also contained 0.59 parts by weight of a zinc stearate lubricant for every 100 parts by weight of the composition defined above.

In the mixture, the copper powder was electrolytic copper and had a purity of at least 99%, the major impurities being lead (maximum of 0.2% by weight) and oxygen (maximum 0.2% by weight). A particle size analysis of the copper powder showed that not more than 0.2% by weight had a size in excess of 53 microns.

The lead powder in the mixture was atomised lead and had a purity of at least 99.95% so that the effect of any impurities was negligible. A particle size analysis showed that 1% by weight of the lead powder had a particle size in excess of 150 microns, 10% by weight had a particle size between 75 and 150 microns, and 15% by weight had a particle size between 45 and 75 microns, the particle size of the remainder being 45 microns or below.

The tin powder was that supplied as 53 micron tin and had a purity of at least 99% so that again the effect of any impurities was negligible. A particle size showed that about 97.5% by weight of the powder had a particle size below 53 microns.

The graphite powder employed was 45 micron natural flake, micronised graphite, the particle size being confirmed by a sieve analysis which showed that 99.5% by weight of the powder had a particle size below 45 microns. The graphite powder had a purity of 96 - 97%, the impurities being typically after ashing 1.4% by weight silica, 0.93% by weight alumina, 0.2% by weight calcia, 0.07% by weight each of sulphur and magnesia, 0.68% by weight of iron and not more than 0.2% by weight moisture.

The silicon carbide powder had a mean particle size of 13 microns and was supplied by the Carborundum Company Limited of Manchester as type F500. The purity of the silicon carbide powder was 98.7% and the impurities present were 0.48 % by weight silica, 0.3% by weight silicon, 0.9% by weight iron, 0.1% by weight aluminium and 0.3% by weight carbon.

The zinc stearate luricant was that supplied by Witco Chemical Limited, as technical grade 1/s.

To produce the required mixture, the as-supplied powders were introduced in the required proportions into a Turbula mixer, and mixed for 100 minutes. The resultant powder was then poured into a die cavity defined within a tungsten carbide die whereafter one end of an electrical lead formed of tough pitch high conductivity copper was inserted into the powder in the die cavity. The powder was subsequently pressed around the lead using an applied pressure of 10 - 35 tons F/in$^2$, preferably 19 tons F/in$^2$, and after removal from the die cavity, the assembly was heated in a nitrogen atmosphere. Initially heating was effected at 450° C for 15 minutes to remove the lubricant, whereafter the temperature was raised to the required sintering value of between 600° and 880° C, preferably 800° C, and retained at this upper value for 20 minutes. On cooling to room temperature, the resultant component was read for use as a brush for a dynamo electric machine.

The brush produced according to the above example was intended for use with a commutator of the kind in which the insulating material between adjacent conductive segments extended flush with the brush engaging surfaces of the segments. It was therefore necessary that the brush was able to cope with the variation in material at the brush engaging surface of the commutator while at the same time exhibiting a low wear rate of the brush together with a low rate of commutator wear. When the brush of the above example was tested with such a commutator, it was found that the brush operated satisfactorily and both the commutator and the brush exhibited a low wear rate.

The method of the first example was then repeated with a plurality of further starting compositions in which the particle size of the silicon carbide powder was varied between 3 and 23 microns. The resultant brushes were then tested in a road vehicle starter motor employing a commutator of the kind specified and the amount of wear experienced by the brushes and the commutator were measured after about 20–30000 operations of the motor. The results of these tests, together with the corresponding results obtained with the brush described above are given in Table 1 below.

TABLE 1

| Brush No. | Mean particle size (Microns) | No. of operations | Maximum brush wear rate/ 1000 operations (inch) | Total commutator wear (inch) |
|---|---|---|---|---|
| 1 | 3 | 30,000 | $7 \times 10^{-3}$ | $7 \times 10^{-3}$ |

-continued

| Brush No. | Mean particle size (Microns) | No. of operations | Maximum brush wear rate/ 1000 operations (inch) | Total commutator wear (inch) |
|---|---|---|---|---|
| 2 | 3 | 30,000 | $6.6 \times 10^{-3}$ | $3 \times 10^{-3}$ |
| 3 | 3 | 31718 | $8.9 \times 10^{-3}$ | $1 \times 10^{-2}$ |
| 4 | 3 | 30243 | $9.4 \times 10^{-3}$ | $5 \times 10^{-2}$ |
| 5 | 6.5 | 20127 | $6.7 \times 10^{-3}$ | $2 \times 10^{-3}$ |
| 6 | 6.5 | 20025 | $5.2 \times 10^{-3}$ | $4 \times 10^{-3}$ |
| 7 | 6.5 | 30513 | $8.4 \times 10^{-3}$ | $4 \times 10^{-3}$ |
| 8 | 6.5 | 24150 | $7.2 \times 10^{-3}$ | $4 \times 10^{-3}$ |
| 9 | 9 | 25820 | $6.9 \times 10^{-3}$ | $1.2 \times 0\ 10^{-2}$ |
| 10 | 9 | 30458 | $5.6 \times 10^{-3}$ | $6 \times 10^{-3}$ |
| 11 | 12 | 34600 | $4.1 \times 10^{-3}$ | $2.3 \times 10^{-2}$ |
| 12 | 13 | 21244 | $3.8 \times 10^{-3}$ | $1 \times 10^{-2}$ |
| 13 | 13 | 33360 | $5.0 \times 10^{-3}$ | $9 \times 10^{-3}$ |
| 14 | 13 | 30927 | $4.6 \times 10^{-3}$ | $1.6 \times 10^{-2}$ |
| 15 | 17 | 30000 | $6.2 \times 10^{-3}$ | $2 \times 10^{-2}$ |
| 16 | 17 | 18556 | $4.8 \times 10^{-3}$ | $1.6 \times 10^{-2}$ |
| 17 | 18 | 30132 | $4.2 \times 10^{-3}$ | $8 \times 10^{-3}$ |
| 18 | 18 | 30000 | $4.0 \times 10^{-3}$ | $8 \times 10^{-3}$ |
| 19 | 20 | 30012 | $4.9 \times 10^{-3}$ | $9.6 \times 10^{-2}$ |
| 20 | 20 | 30011 | $6.6 \times 10^{-3}$ | $9 \times 10^{-2}$ |
| 21 | 23 | 27096 | $6.5 \times 10^{-3}$ | $9 \times 10^{-2}$ |

In the above Table, the figures given for maximum brush wear rate were obtained when four samples of each type of brush were mounted in a starter motor and indicate the wear rate for the sample which had undergone the most wear. From the results listed it will be seen that the lowest values for the brush wear rate were obtained when the silicon carbide particle size was from 9 to 18 microns and, in particular 12 to 18 mircons, it being appreciated that a maximum brush wear rate of not more than $5 \times 10^{-3}$inch/1000 operations represents a highly attractive brush from a commerical viewpoint. It will also be seen from Table 1 that the commutator wear was very low for each type of brush tested, except in the case of the 20 and 23 micron samples where considerable wear of the commutator was evident.

In a second example of the present invention, a plurality of further brushes were produced by repeating the procedure of the first example but with the concentration of the silicon carbide in the starting mixture being varied. In each case, the concentration of the copper powder was adjusted to take account of the silicon carbide variation and the particle size of the silicon carbide powder was maintained at 13 microns. As in the previous example, each of the resultant brushes was then tested in a starter motor employing a commutator of the kind specified. The results are summarised in Table 2.

TABLE 2

| Brush No. | Silicon Carbide Concentration (%) by weight | No. of operations | Maximum brush wear rate/1000 operations (inch) | Total commutator wear (inch) |
|---|---|---|---|---|
| 22 | 0 | 20,000 | $1.4 \times 10^{-2}$ | $6 \times 10^{-3}$ |
| 23 | 0.4 | 30,608 | $6.9 \times 10^{-3}$ | $2.5 \times 10^{-2}$ |
| 24 | 0.4 | 31,025 | $6.68 \times 10^{-3}$ | $1.0 \times 10^{-3}$ |
| 25 | 0.6 | 31,871 | $8.74 \times 10^{-3}$ | $1.5 \times 10^{-2}$ |
| 26 | 0.6 | 30.781 | $6.80 \times 10^{-3}$ | $1.5 \times 10^{-2}$ |
| 27 | 0.7 | 30,601 | $5.48 \times 10^{-3}$ | $6 \times 10^{-3}$ |
| 28 | 0.7 | 32,904 | $5.54 \times 10^{-3}$ | $3.4 \times 10^{-2}$ |
| 29 | 0.85 | 25,795 | $3.96 \times 10^{-3}$ | $7 \times 10^{-3}$ |
| 30 | 0.85 | 31,037 | $5.38 \times 10^{-3}$ | $8 \times 10^{-3}$ |
| 31 | 1.70 | 33,360 | $5.1 \times 10^{-3}$ | $9 \times 10^{-3}$ |
| 32 | 1.70 | 30,927 | $4.67 \times 10^{-3}$ | $1.6 \times 10^{-2}$ |
| 33 | 3.40 | 30,000 | $6.26 \times 10^{-3}$ | $1.5 \times 10^{-2}$ |
| 34 | 3.40 | 30.875 | $3.89 \times 10^{-3}$ | $1.5 \times 10^{-2}$ |
| 35 | 4.25 | 30,190 | $85 \times 10^{-3}$ | $6.0 \times 10^{-2}$ |
| 36 | 4.25 | 30,037 | $8.86 \times 10^{-3}$ | $5.8 \times 10^{-2}$ |
| 37 | 5.1 | 30,146 | $6.26 \times 10^{-3}$ | $1.4 \times 10^{-2}$ |
| 38 | 5.1 | 32,246 | $7.22 \times 10^{-3}$ | $1.5 \times 10^{-2}$ |
| 39 | 8.5 | 36,990 | $1.0 \times 10^{-2}$ | $3.8 \times 10^{-2}$ |

TABLE 2-continued

| Brush No. | Silicon Carbide Concentration (%) by weight | No. of operations | Maximum brush wear rate/1000 operations (inch) | Total commutator wear (inch) |
|---|---|---|---|---|
| 40 | 8.5 | 36,250 | $1.01 \times 1^{-2}$ | $3.7 \times 10^{-2}$ |

From Table 2 it will be seen that the lowest values for the maximum brush wear rate were obtained when the silicon carbide concentration was between 0.85 and 3.4%. A comparable brush formulation containing 18 micron silicon carbide gave low values of brush wear up to a 5.1% weight concentration. In each case the commutator wear was low.

In a third example, a plurality of brushes were produced from starting mixtures containing the same quantites of tin and lead as in the above examples, 1.7% by weight of 13 micron particle size silicon carbide and varying amounts of graphite (99.5% having a particle size below 45 microns), the remainder of each mixture again being copper. The resultant brushes were subjected to the tests outlined above and the results are given in Table 3.

TABLE 3

| Brush No. | Graphite concentration (% by weight) | No. of operations | Maximum brush wear rate/1000 Operations (inch) | Total commutator wear (inch) |
|---|---|---|---|---|
| 41 | 0 | 3,145 | $3 \times 10^{-2}$ | |
| 42 | 0 | 16,070 | $1.68 \times 10^{-2}$ | $8 \times 10^{-3}$ |
| 43 | 2 | 30,035 | $5.43 \times 10^{-3}$ | $1.2 \times 10^{-2}$ |
| 44 | 2 | 30,194 | $7.82 \times 10^{-3}$ | $1.5 \times 10^{-2}$ |
| 45 | 2.5 | 30,265 | $5.39 \times 10^{-3}$ | $6.0 \times 10^{-3}$ |
| 46 | 3.0 | 30,151 | $6.34 \times 10^{-3}$ | $9 \times 10^{-3}$ |
| 47 | 3.0 | 33,756 | $4.24 \times 10^{-3}$ | $1.5 \times 10^{-2}$ |
| 48 | 4.0 | 33,360 | $5.1 \times 10^{-3}$ | $9 \times 10^{-3}$ |
| 49 | 4.0 | 30,927 | $4.67 \times 10^{-3}$ | $1.6 \times 10^{-2}$ |
| 50 | 4.0 | 21,244 | $3.8 \times 10^{-3}$ | $1.0 \times 10^{-2}$ |
| 51 | 5.0 | 30,025 | $8.14 \times 10^{-3}$ | $1.5 \times 10^{-2}$ |
| 52 | 5.0 | 31,610 | $5.6 \times 10^{-3}$ | $1.0 \times 10^{-2}$ |
| 53 | 6.0 | 30,000 | $7.16 \times 10^{-3}$ | $7 \times 10^{-3}$ |
| 54 | 6.0 | 30.098 | $5.49 \times 10^{-3}$ | $1 \times 10^{-2}$ |

From Table 3 it will be seen that the brush wear rate was high when graphite was absent, decreased as the graphite concentration was increased to 4.0% by weight, and rose again when the graphite concentration reached 6% by weight. In each case the commutator wear was low. A similar pattern was observed when 18 micron silicon carbide was used, all other concentrations and particle sizes remaining as in the third example. Thus the brush wear rate fell from 6.4–9.4 $\times 10^{-3}$ in/1000 operations when 1% by weight of graphite was used to a minimum of 4–4.6 $\times 10^{-3}$ in/1000 operations when 4 % by weight of graphite was used, but increased again significantly when the graphite concentration rose above 8% by weight.

In a fourth example, the process of the preceding example was repeated using 18 micron particle size silicon carbide and with the graphite concentration being maintained at the optimum value of 4% by weight and with the quantities of tin and lead being varied. The resultant brushes were tested as before and the results are shown in Table 4.

TABLE 4

| Brush No. | Tin Conc. % by weight | Lead Conc. % by weight | No. of operations | Maximum brush wear rate/1000 operations (inch) | Total commutator wear (inch) |
|---|---|---|---|---|---|
| 55 | 0 | 15.3 | 20000 | $6.5 \times 10^{-3}$ | $6 \times 10^{-3}$ |

TABLE 4-continued

| Brush No. | Tin Conc. % by weight | Lead Conc. % by weight | No. of operations | Maximum brush wear rate/1000 operations (inch) | Total commutator wear (inch) |
|---|---|---|---|---|---|
| 56 | 0 | 15.3 | 20235 | $4.6 \times 10^{-3}$ | $6 \times 10^{-3}$ |
| 57 | 1 | 14.3 | 11640 | $4.3 \times 10^{-3}$ | $1 \times 10^{-2}$ |
| 58 | 1 | 14.3 | 22000 | $5.6 \times 10^{-3}$ | $5 \times 10^{-3}$ |
| 59 | 2.55 | 12.75 | 30132 | $4.2 \times 10^{-3}$ | $8 \times 10^{-3}$ |
| 60 | 2.55 | 12.75 | 31043 | $4.5 \times 10^{-3}$ | $8 \times 10^{-3}$ |
| 61 | 2.55 | 12.75 | 30000 | $4 \times 10^{-3}$ | $3 \times 10^{-3}$ |
| 62 | 5 | 10.3 | 20000 | $7.5 \times 10^{-3}$ | $7 \times 10^{-3}$ |
| 63 | 5 | 10.3 | 20000 | $7.5 \times 10^{-3}$ | $5 \times 10^{-3}$ |

From Table 4 it will be seen that the brush wear rate decreased as the tin content was increased up to 2.55% by weight but that this improvement had disappeared by the time the content had reached 5% by weight. It is, however, to be noted that the wear rate in the absence of tin would have been acceptable for many applications. Again the commutator wear was low for each brush.

In addition to the samples shown in Table 4, further samples using 13 micron silicon carbide were tested, in which the lead content was reduced to 9% by weight and 7.5% by weight respectively. In each of these further examples the tin concentration was maintained at 2.55% by weight, and so the copper concentration was increased by 3.75% by weight and 5.25% by weight respectively to make up the deficit. These further samples showed both low brush wear rate and low commutator wear. However, when the lead content was reduced to the order of 6% by weight with the copper having been increased by 6.75% by weight, heavy brush and commutator wear was observed when such brushes were tested.

In a fifth example, the effect of varying the copper particle size was investigated using a starting mixture as described in the first example but with the particle size of the silicon carbide powder being 18 microns. The results are summarised in Table 5.

TABLE 5

| Brush No. | Copper Particle Size | No. of operations | Maximum brush wear rate/1000 operations (inch) | Total commutator wear (inch) |
|---|---|---|---|---|
| 64 | 99.8% <53μ | 30132 | $4.2 \times 10^{-3}$ | $8 \times 10^{-3}$ |
| 65 | 99.8% <53μ | 31043 | $4.7 \times 10^{-3}$ | $8 \times 10^{-3}$ |
| 66 | 99.8% <53μ | 30000 | $3.5 \cdot 10^{-3}$ | $3 \times 10^{-3}$ |
| 67 | 30–45% <45μ | 20000 | $4.8 \times 10^{-3}$ | $5 \times 10^{-3}$ |
| 68 | 30–45% <45μ | 20000 | $3.4 \times 10^{-3}$ | $3 \times 10^{-3}$ |
| 69 | >106μ21132 | $1.45 \times 10^{-2}$ | $4 \times 10^{-3}$ | |
| 70 | >106μ | 10116 | $1.34 \times 10^{-2}$ | $4 \times 10^{-3}$ |
| 71 | <75μ | 20083 | $5.6 \times 10^{-3}$ | $3 \times 10^{-3}$ |
| 72 | <75μ | 20003 | $8.5 \times 10^{-3}$ | $5 \times 10^{-3}$ |
| 73 | <45μ | 20066 | $4.8 \times 10^{-3}$ | $5 \cdot 10^{-3}$ |

From Table 5 it will be seen that the preferred particle size for the copper powder is less than 106 microns and particularly below 53 microns.

In each of the brushes produced according to the above examples, the silicon carbide has defined the required hard phase of the brush. It is, however, to be appreciated that silicon carbide powder has an indentation hardness (VPN) value between 1890 and 3430 (mean 2876) when using a 200g load, and is therefore normally used for cutting tools and for its abrasive properties. However, its inclusion in the material of the invention has allowed an electrical brush to be produced exhibiting very little wear not only of the brush itself, but also of the copper commutator upon which it rubs. Even though it performed well as an electrical brush, it was feared that the life of the tungsten carbide tools used for producing such brushes would suffer (the hardness of tungsten carbide is less than silicon carbide). It has been found, however, that the tool life is conducive to high quantity production. Moreover, it is to be understood that, although silicon carbide is a ceramic material, its resistivity of $10^{-3}$ – $10^{-1}$ ohm cm is sufficiently low for it to act as an electrically conductive component of the sintered brush.

We claim:

1. A brush for a dynamo electric machine comprising a sintered composition substantially composed of the following ingredients by weight:

| | |
|---|---|
| Carbon | 1 – 8% |
| Silicon Carbide | 0.85 – 5.1% |
| Tin | 0 – 4% |
| Lead | 7.5 – 15.3%, |
| Copper | and remainder |

2. A brush as claimed in claim 1, wherein the sintered composition comprises 4% by weight carbon, 1.7% by weight silicon carbide, 2.55% by weight tin and 12.75% by weight lead, the remainder being copper.

3. A method of producing a brush for a dynamo electric machine, comprising the step of sintering a compacted powder mixture wherein the powder mixture has substantially the following composition by weight:

| | |
|---|---|
| Carbon | 1 – 8% |
| Silicon Carbide | 0.85 – 5.1% |
| Tin | 0 – 4% |
| Lead | 7.5 – 15.3%, |
| Copper | and remainder |

4. A method as claimed in claim 3, wherein the silicon carbide powder in said mixture has a mean particle size between 9 and 18 microns.

5. A method as claimed in claim 3 wherein the silicon carbide powder in said mixture has a mean particle size between 12 and 18 microns.

6. A method as claimed in claim 3 wherein the silicon carbide powder in said mixture has a mean particle size of 13 microns.

7. A method as claimed in claim 3 wherein the copper powder in said mixture has a mean particle size of less than 106 microns.

8. A method as claimed in claim 3 wherein the copper powder in said mixture has a mean particle size of less than 53 microns.

9. A method as claimed in claim 3 wherein an electrical lead for the brush is metallurgically bonded thereto during sintering of said mixture.

10. A method as claimed in claim 3, wherein the powder mixture also contains a lubricant which aids compaction of the mixture and is removed during the sintering step.

* * * * *